US007494564B2

(12) United States Patent
Basler et al.

(10) Patent No.: US 7,494,564 B2
(45) Date of Patent: Feb. 24, 2009

(54) ABSORBENT PAPER PRODUCT HAVING IMPROVED EMBOSSING

(75) Inventors: Michel Basler, Issenheim (FR); Benoît Hoeft, Bischwihr (FR); Sébastien Jeannot, Colmar (FR); Nicolas Pommier, Colmar (FR)

(73) Assignee: Georgia-Pacific France, Kunheim (FR)

( * ) Notice: Subject to any disclaimer, the term of this patent is extended or adjusted under 35 U.S.C. 154(b) by 441 days.

(21) Appl. No.: 10/792,824

(22) Filed: Mar. 5, 2004

(65) Prior Publication Data

US 2004/0231813 A1 Nov. 25, 2004

(30) Foreign Application Priority Data

Mar. 7, 2003 (EP) ..... 03005090

(51) Int. Cl.
*B31F 1/07* (2006.01)
*D21H 27/40* (2006.01)
*D21H 21/30* (2006.01)

(52) U.S. Cl. ..... 162/117; 162/12; 428/156; 428/166; 428/174; 428/212; 428/218

(58) Field of Classification Search ..... 162/109, 162/117, 123–133; 428/156, 172, 174, 537.5, 428/153, 173, 154, 166, 212; 156/209, 219
See application file for complete search history.

(56) References Cited

U.S. PATENT DOCUMENTS

| | | | | |
|---|---|---|---|---|
| 5,173,351 | A * | 12/1992 | Ruppel et al. | 428/174 |
| 5,620,776 | A * | 4/1997 | Schulz | 428/156 |
| 6,086,715 | A * | 7/2000 | McNeil | 162/132 |
| 6,106,928 | A * | 8/2000 | Laurent et al. | 428/152 |
| 6,277,466 | B1 * | 8/2001 | McNeil et al. | 428/154 |
| 6,287,676 | B1 * | 9/2001 | Ruppel et al. | 428/219 |
| 6,551,691 | B1 * | 4/2003 | Hoeft et al. | 428/172 |
| 6,599,614 | B1 * | 7/2003 | Roussel et al. | 428/172 |
| 6,656,569 | B1 * | 12/2003 | Roussel et al. | 428/154 |
| 6,723,203 | B2 * | 4/2004 | Roussel et al. | 162/111 |
| 6,916,403 | B2 * | 7/2005 | Basler et al. | 162/117 |
| 6,942,755 | B2 * | 9/2005 | Basler et al. | 162/117 |
| 7,029,546 | B2 * | 4/2006 | Basler et al. | 156/209 |
| 7,083,845 | B2 * | 8/2006 | Graff | 428/166 |
| 2002/0148579 | A1 * | 10/2002 | Roussel et al. | 162/111 |
| 2002/0160155 | A1 * | 10/2002 | Muller | 428/172 |
| 2003/0008109 | A1 * | 1/2003 | Basler et al. | 428/156 |
| 2003/0021953 | A1 * | 1/2003 | Graff | 428/153 |
| 2003/0118782 | A1 * | 6/2003 | Graff | 428/172 |
| 2003/0129363 | A1 * | 7/2003 | Hoeft et al. | 428/172 |
| 2004/0074594 | A1 * | 4/2004 | Basler et al. | 156/184 |
| 2004/0081804 | A1 * | 4/2004 | Basler et al. | 428/174 |
| 2004/0121124 | A1 * | 6/2004 | Basler et al. | 428/154 |
| 2004/0231813 | A1 * | 11/2004 | Basler et al. | 162/123 |
| 2005/0034828 | A1 * | 2/2005 | Graff et al. | 162/123 |
| 2005/0257910 | A1 * | 11/2005 | Boatman et al. | 162/362 |
| 2006/0113049 | A1 * | 6/2006 | Knobloch et al. | 162/117 |
| 2006/0278354 | A1 * | 12/2006 | Russell et al. | 162/117 |
| 2007/0056704 | A1 * | 3/2007 | Wilke | 162/117 |
| 2007/0122595 | A1 * | 5/2007 | Basler et al. | 428/174 |

FOREIGN PATENT DOCUMENTS

| | | | |
|---|---|---|---|
| CA | 2458952 | A1 * | 9/2004 |
| EP | 426548 | A1 * | 5/1991 |
| EP | 1081284 | A1 * | 3/2001 |
| EP | 1270196 | A1 * | 1/2003 |
| EP | 13911774 | A1 * | 2/2004 |
| EP | 1455014 | A1 * | 9/2004 |
| EP | 1520930 | A1 * | 4/2005 |
| FR | 2861642 | A1 * | 5/2005 |
| GB | 2376436 | A * | 12/2002 |
| GB | 2377674 | A * | 1/2003 |
| WO | WO 9618771 | A1 * | 6/1996 |
| WO | WO 186066 | A2 * | 11/2001 |
| WO | WO 2072956 | A1 * | 9/2002 |
| WO | WO 2005033408 | A2 * | 4/2005 |

* cited by examiner

*Primary Examiner*—José A Fortuna
(74) *Attorney, Agent, or Firm*—Breiner & Breiner, LLC

(57) ABSTRACT

The invention relates to an absorbent paper product, made in particular of tissue paper, that includes at least two plies, at least one of which is embossed according to an embossing pattern that includes projections (1, 2, 3) with a density of 30 or more per $cm^2$. According to the invention, the embossing patterns include at least two adjacent zones whose projections (1, 2, 3) have, respectively, a different density and/or a different surface area at the peak so as to produce a relief effect on the product.

11 Claims, 5 Drawing Sheets

ABSORBENT PAPER PRODUCT HAVING IMPROVED EMBOSSING

FIELD OF INVENTION

This invention relates to the field of absorbent paper for sanitary or household use, and its object is a product that includes at least one embossed ply. The product is basically intended for making toilet paper, but is also for making disposable handkerchiefs, table napkins, or optionally an all-purpose wipe.

BACKGROUND OF INVENTION

In the sanitary and household paper industry, these kinds of products are produced using a generally creped, absorbent, low basis-weight product featuring a design: viz., tissue paper. The structure's elongation capability, which is imparted by, for example, creping, is used to good advantage to emboss the sheet. This operation consists in permanently deforming the sheet between a non-deformable cylinder that is equipped with relief designs and a mating cylinder, for example, one that has a resilient coating. In this way projections are produced on one side that correspond to indentations on the other side.

With regard to hygiene products made of tissue paper, the trend in recent years has been to make them softer and gentler by manipulating their thickness and stiffness characteristics, especially by embossing. The embossing also makes it possible to visually improve the appearance of the product. The embossing operation is carried out on low-moisture-content paper, i.e., by transformation. This manipulation is thus done on a dry sheet unwound from a parent roll coming from the paper machine.

The most popular embossing patterns consist of a series of geometrically-based elementary projections having a small transverse section and a simple geometric shape. One example is described in U.S. Pat. No. 3,414,459, which pertains to a stratified sheet consisting of a plurality of elementary sheets, called plies, that are glued together. The plies are embossed with a distribution frequency and projection height that are adapted for the production of a water-absorbing product, for example, an all-purpose wipe. The number of elements ranges from 5 to 30 per $cm^2$.

For his part, the Applicant has developed, especially for toilet paper, patterns with a larger number of elements, from 30 to 80 per $cm^2$. This kind of embossing is usually described as "microembossing". The relief elements that form the embossing necessarily have an element surface with a very low peak, less than 1 $mm^2$. For these latter implementations, an appearance is obtained that is similar to that of a tissue product. An example thereof is disclosed in EP 426 548.

This kind of product has limited visual appeal, however. Moreover, when two plies that are embossed in this way are attached by gluing, the softness of the product that is obtained is less than optimal.

The solution offered in FR 2 728 152 makes it possible to improve the softness of a two-ply sheet with this kind of embossing by producing a combined pattern that includes a graphic pattern and a background pattern. The graphic pattern is made up of projections whose shape is linear, with a width of between 0.1 and 2 mm, and the background pattern consists of generally tapered small projections that are distributed at a ratio of at least 30 per $cm^2$ (microembossing). The plies are connected along the linear pattern, thus limiting the extent of the glued-together surfaces and the degree of rigidity that is introduced.

In accordance with this embodiment, the vast majority of the embossed surface area is embossed according to the background pattern: 80% of the surface area in practice. This accounts for the vast majority of the functional characteristics associated with the embossing, i.e., thickness and absorbency.

U.S. Pat. No. 5,620,776 is also known from the prior art; it discloses a description of sheets of absorbent paper embossed according to a pattern that forms a grid of diamond-shaped figures whose interior includes a pattern that is composed of linear elements or is formed by aligned projections. The aim of this invention is to produce sheets with better swelling than non-embossed sheets, and sheets on which the patterns stand out better. However, the projection densities employed have nothing to do with microembossing.

EP 1 073 797 is also known from the prior art; it describes a sheet of absorbent paper that has a pattern composed solely of projections of equal size that are distributed according to nearly identical densities, such as to produce homogeneous marking and good definition of the pattern, while at the same time ensuring thickness and strength characteristics that are comparable to those of a sheet having uniform embossing.

The embossing pattern disclosed in this patent includes a network of cells whose interiors have little or no embossing.

In most cases, the goal is thus to strike a compromise between the density of the pattern-forming element(s), the surface area that they occupy, their shapes, their marking, etc.

The above-mentioned parameters can be manipulated depending on the effects that one wishes to achieve: softness, thickness, absorbency, aesthetics, strength.

The known kinds of microembossing have densities that are equal and/or essentially equal over the entire surface areas of the products.

OBJECTS AND BRIEF SUMMARY OF THE INVENTION

According to this invention, an attempt is made to obtain an embossed product that has an improved relief per se, without its other properties being impaired or otherwise altered in any way.

According to the invention, the improved relief is essentially obtained through a characteristic embossing.

Moreover, the product according to the invention advantageously has a relatively large thickness and in no way gives the impression (either to the eye or to the touch) of being compressed or flattened.

Thus, the object of the invention is an absorbent paper product, made in particular of tissue paper, that includes at least two plies, at least one of which is embossed according to an embossing pattern that contains projections with a density of 30 or more per $cm^2$.

According to the invention, the embossing pattern includes at least two adjacent zones whose projections have, respectively, different densities and/or different peak surface areas so as to produce a relief effect on the product.

Without departing from the spirit and scope of the invention, the ratio between the surface area taken up by the peaks of the projections and the embossed surface area, i.e., the surface area occupied by one or more embossed zones on the sheets, is between 1 and 60% and preferably between 7 and 45%.

It is advantageous for the difference in density and/or surface area at the peaks of the projections to be greater than 7% and preferably greater than 15%.

Furthermore, the surface area at the peaks of the smallest projections is at least 0.03 $mm^2$.

In addition, the surface area at the peaks of the largest projections is at the most on the order of 0.80 $mm^2$ According to one embodiment of the invention, the embossing pattern includes at least a first zone where the projections have a first density, whereby the first zone is surrounded by at least one second zone whose projections have a second density that is greater than the first density.

According to an additional characteristic of the invention, the embossing pattern also includes linear elements.

More particularly, the linear elements define a second geometric grid and/or aesthetic patterns.

The plies are preferably assembled together by gluing.

According to a preferred embodiment of the invention, the product contains at least two embossed plies.

Without departing from the scope of the invention, the product can include three plies: two outer embossed plies and a middle, non-embossed ply.

BRIEF DESCRIPTION OF THE DRAWINGS

Other features, details, and advantages of the invention will be better understood from the description that follows, which is given solely by way of illustration and not limitation, with reference to the accompanying drawings, wherein.

DETAILED DESCRIPTION OF THE PRESENTLY PREFERRED EMBODIMENTS

Hereinafter, in the common language of the paper-making technique in question, "projections" are elements in relief on the sheet or the ply made of tissue paper, while "picots" are elements in relief on the cylinder that is intended to form the projections on the tissue paper product.

Moreover, microembossing usually includes projections with a density of more than 30 or else more than 50 projections/$cm^2$.

Figure 1:
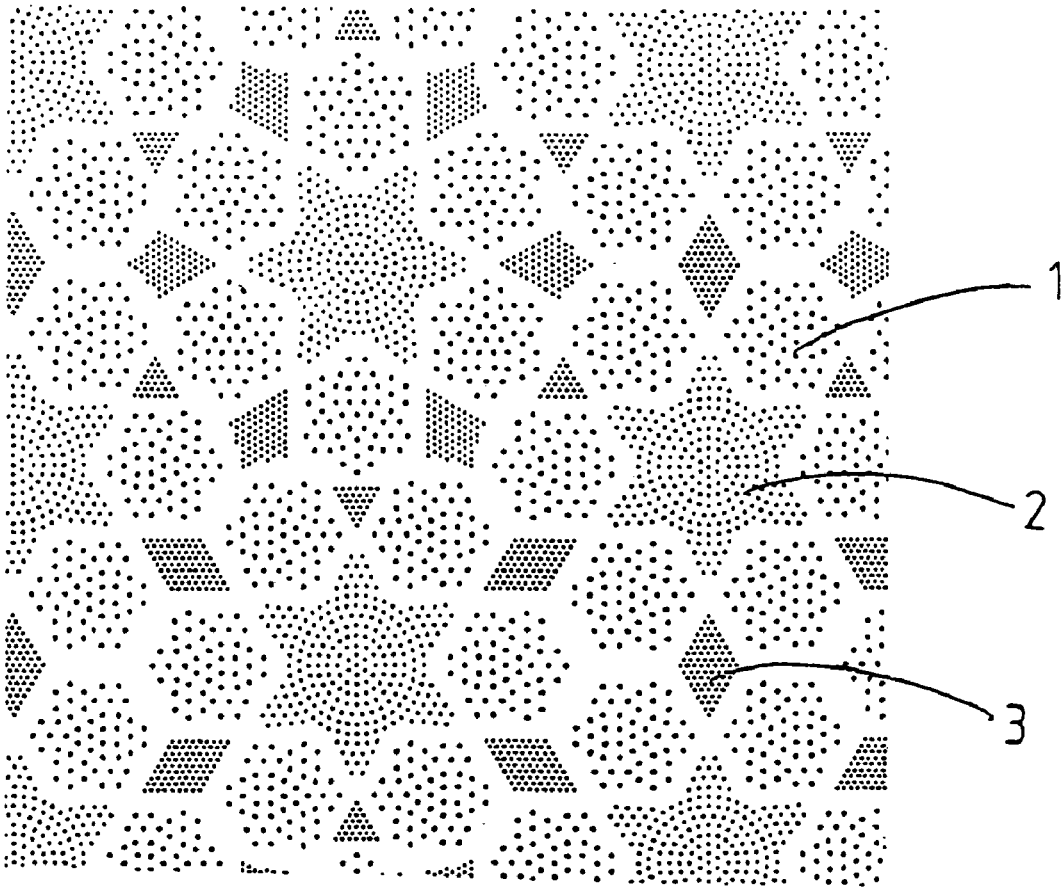
FIG. 1 shows a top plan view of a product that is embossed according to one embodiment of the invention.

FIG. 1 shows an embossing pattern that is made on a product in according with the invention.

More specifically, this pattern includes a first zone 1 with microembossing that has a first density, whereby the a first zone is surrounded by other microembossing zones 2, 3, which have, respectively, a second density that is different from the first density and a third density that is different from the first two densities.

Similarly, the surface areas at the peaks of the projections of the adjacent zones may be different.

According to the embodiment of FIG. 1:

The first microembossing 1 has a density of, for example, 32 projections/$cm^2$ in the shape of hexagons;

The second microembossing 2 has a projection density of 72 projections/$cm^2$and has star-shaped patterns.

The third microembossing 3 is the densest because in this case the projections have a density of 157 projections/$cm^2$.

The third microembossing is formed in the shape of diamond-shaped figures.

The three types of embossing, 1, 2, 3, are juxtaposed on at least one ply, and they make it possible to produce a sheet with a well-pronounced relief.

The following calculation method was used to compute density:

The "embossed surface area" corresponds to the zone that is bounded by a line that passes through the centers of gravity of the projections that form the outer contour of the zone in question.

The "number of projections" is equal to the number of projections located inside the zone, to which is added one-half of the number of projections located on the above-mentioned contour line.

Density is equal to the ratio of the "number of projections" to the "embossed surface area".

In the context of the invention, a "zone" includes at least 10 projections that are aligned in at least two rows.

Figure 2:
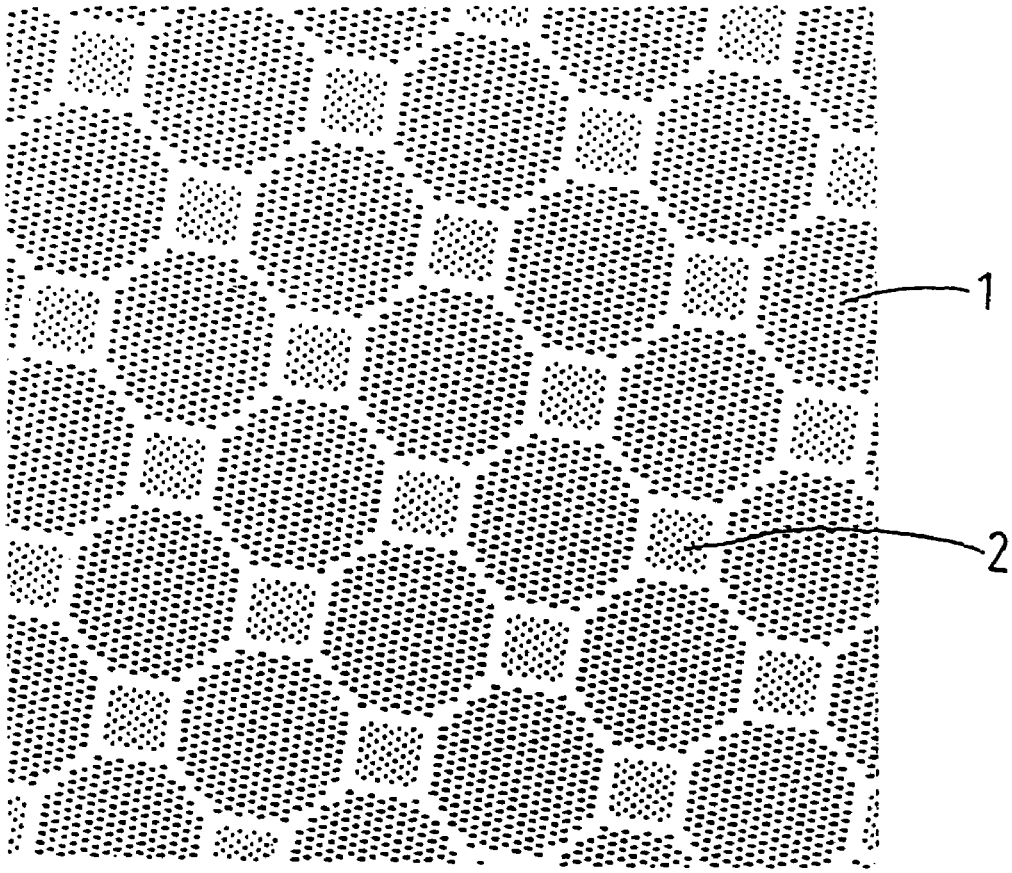
FIG. 2 shows a top plan view of a product that is embossed according to another embodiment of the invention.

FIG. 2 shows another embodiment of the invention, according to which the embossing pattern includes two types of microembossing: the first type is composed of first zones 1 that are equipped with projections that have a first projection density of 61 projections/$cm^2$ and a first peak surface area of 0.23 $mm^2$; these zones are in the form of octagons.

Interspersed among the first zones are second microembossed zones 2, which are square in shape and whose projections have a second density (81 projections/$cm^2$) and a second peak surface area: 0.13 $mm^2$.

The two kinds of zones are juxtaposed. This results in a well-defined relief on each tissue paper sheet.

There are no linear projections in this embossing pattern.

Figure 3:
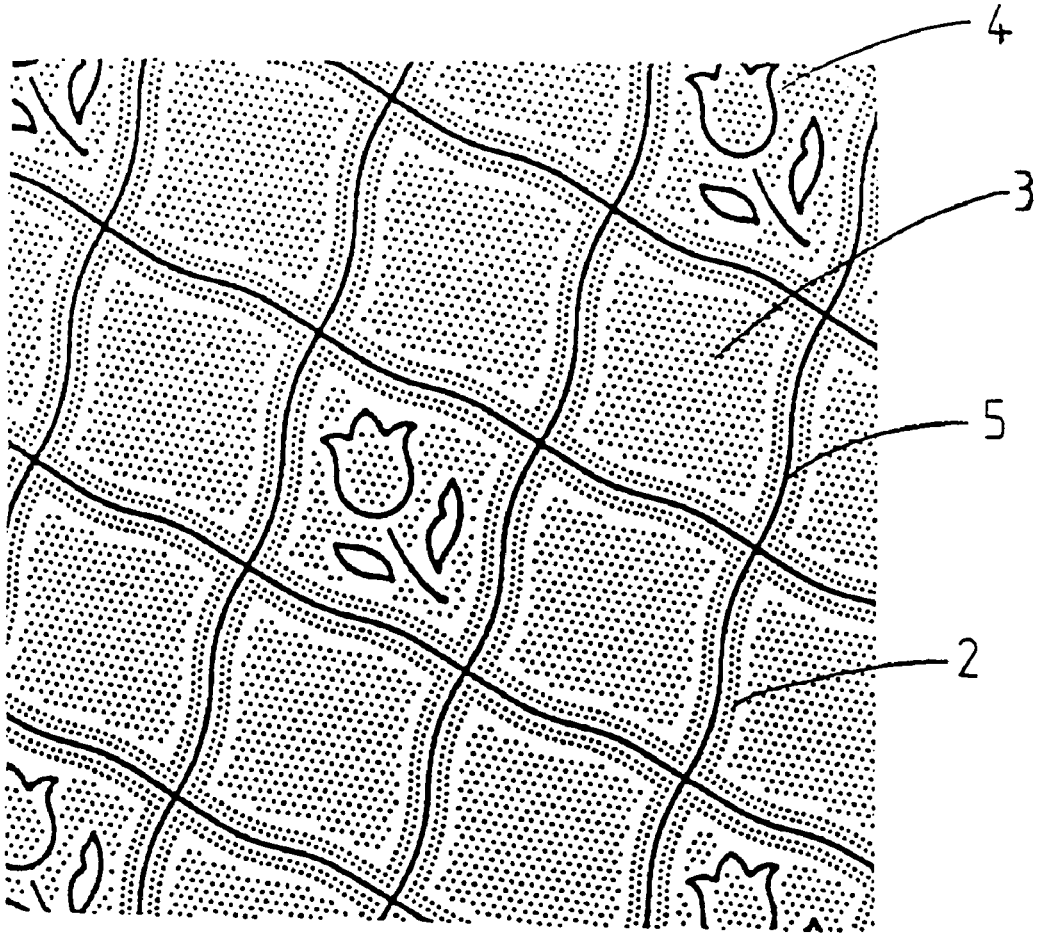
FIG. 3 shows a top view of a product that is embossed according to yet another embodiment of the invention.

FIG. 3 shows yet another embossing pattern according to the invention.

The pattern shown here is composed of three juxtaposed zones that are simultaneously bounded by first linear elements 5 and second zones 2 consisting of high-density projections.

Over some or all of their surface areas, zones 3 include uniformly distributed projections that have a density that is less than the density of the projections that form the zones 2.

According to the invention, the difference in projection density between the different zones is greater than 15%.

In addition, within certain zones 3, second linear elements 4 define aesthetic patterns, in this case, tulips.

Of course, the pattern shown in FIG. 3 is only one example, which is in no way limiting.

In particular, the linear elements 1, 4 do not necessarily have to be present. When they are present, they make the relief stand out even more sharply.

In all cases, microembossing is done such that the sheet has a readily visible and well-defined relief.

In addition, the plies can be assembled by gluing: preferably the gluing is done on all or some of the microembossed and/or linear-pattern zones.

Furthermore, tests have also been conducted while embossing a sheet of tissue paper (or ply) between a cylinder that is engraved with a pattern according to the invention and a rubber cylinder. This sheet was then attached to a non-embossed sheet. The thickness of the structure that was thus obtained was measured by means of a LORENTZEN & WETTRE micrometer, reference SE050, utilized according to standard NF EN 12625-3.

Five different embossing pressures were applied between the steel and the rubber; these pressures were detected by means of carbon paper. For each pressure, a sheet of carbon paper was placed between the engraved cylinder and the rubber. The rubber was crushed upon contact with the engraved cylinder and "imprinted" the pattern on the carbon paper. The NIP or imprint corresponded to the width of the mark that was left by the engraved cylinder on the carbon paper. This mark was more or less wide depending on the embossing pressure applied.

Figure 4:
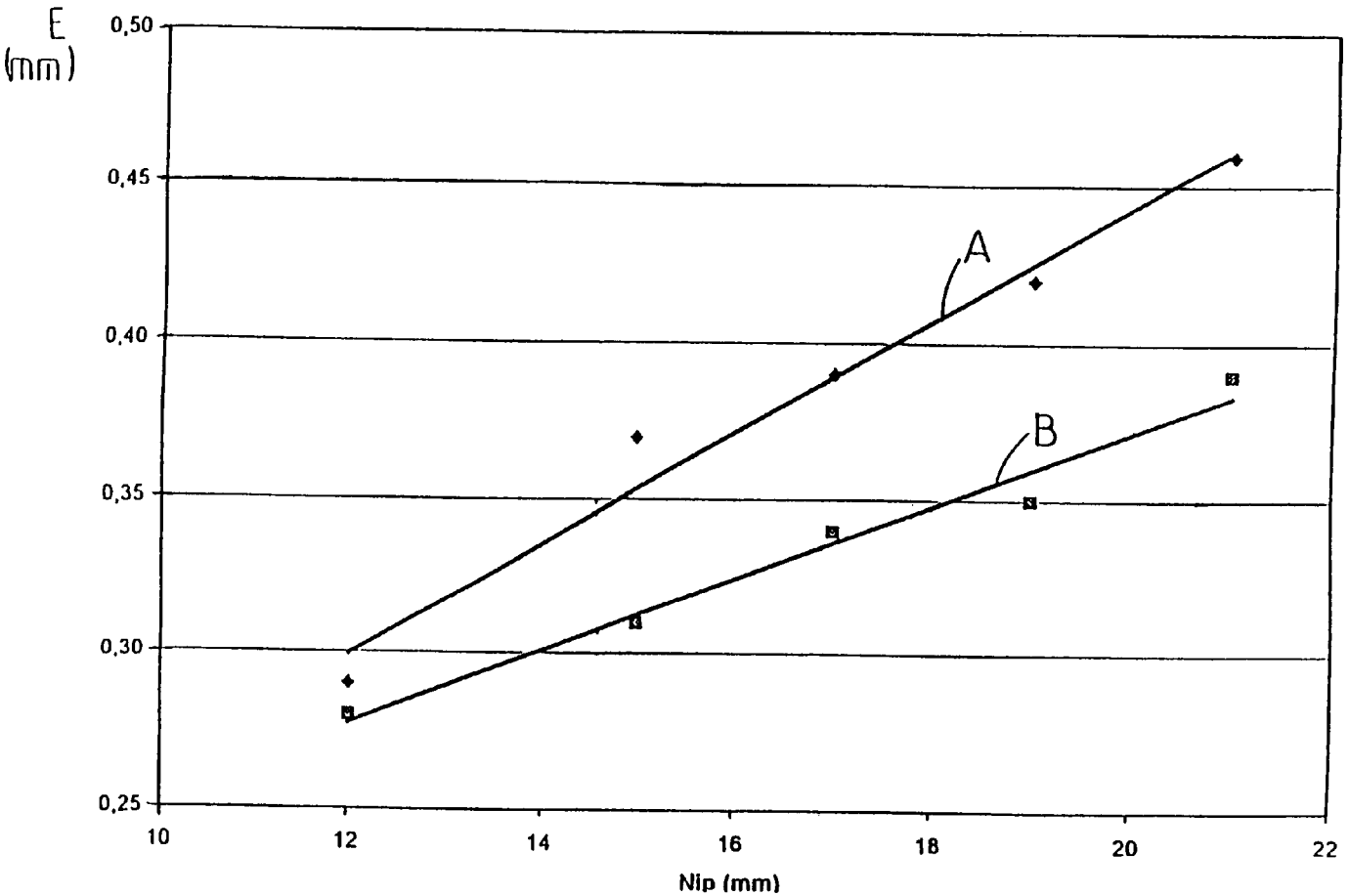
FIG. 4 is a graph that shows the relationship between thickness and imprint for products of the same density that have projections with different peak surface areas.

FIG. 4 shows the first set of tests that was designed to demonstrate the effects of the surface area at the peak (or dimension) of the picots on the cylinder on the thickness of the product that was obtained. Starting with the same picot density, in this case 60 picots/$cm^2$, tests were carried out on patterns having the same depth and, respectively, picots with a peak diameter of 0.4 mm and 0.6 mm. The thicknesses of the products are plotted on the ordinate, while the NIP or imprint left by the cylinder on the carbon paper is plotted on the abscissa.

Curve A corresponds to products that are formed on cylinders having picots with a diameter at the peak that is essentially equal to 0.4 mm, while curve B pertains to products that are formed on cylinders whose picots have a diameter that is essentially equal to 0.6 mm. A comparison of these curves shows that, for the same imprint, a greater thickness of the structure is attained when it is produced with an engraved cylinder whose picots have the smaller surface area at the peak.

Figure 5:
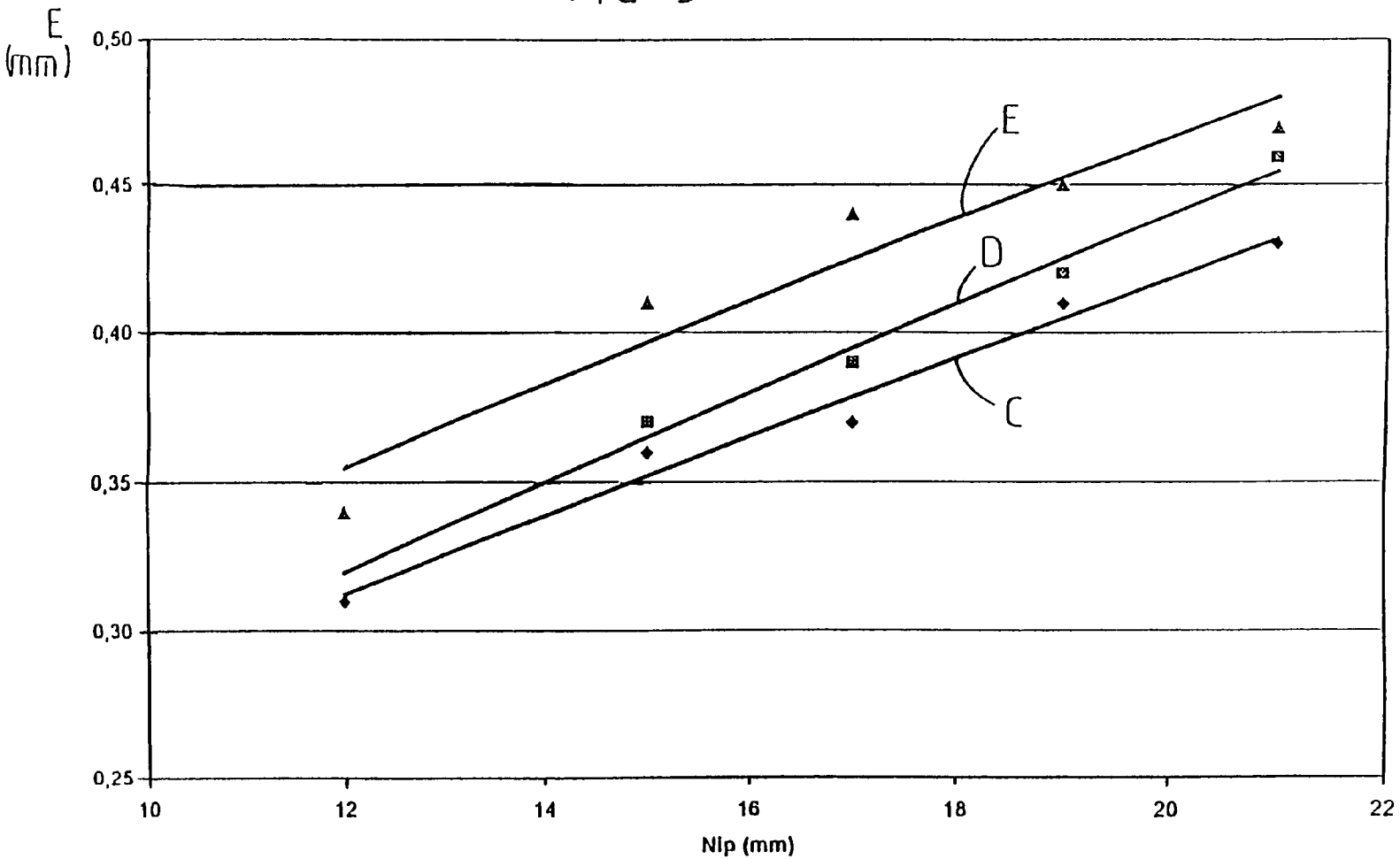
FIG. 5 is a graph that shows the relationship between thickness and imprint for products of different densities that have projections with the same surface areas.

In FIG. 5, based on a second series of tests as defined above, curves C, D, and E were obtained for three products whose embossing patterns had three different projection densities. Three different cylinders were used.

Starting with picots with the same diameter on the cylinders, in this case 0.4 mm, tests were conducted on patterns having the same depth and picot densities of, respectively, 50, 60, and 80 projections/$cm^2$.

It is clear that, with the same imprint, the smaller the density of the picots, the thicker the product obtained.

Thus, by juxtaposing zones of embossing patterns having different densities and/or surface areas at the peak, it is possible to obtain different product thicknesses, and thereby to create the desired relief effect, on the final product.

The relationship between varying the thickness of the product and the relief effect is thus well-established.

As will be apparent to one skilled in the art, various modifications can be made within the scope of the aforesaid description. Such modifications being within the ability of one skilled in the art form a part of the present invention and are embraced by the appended claims.

The invention claimed is:

1. An absorbent paper product made substantially of tissue paper comprising at least two plies with at least one of said at least two plies being embossed according to an embossing pattern that includes projections of a density of at least 30 per $cm^2$ arranged in zones, each zone including at least 10 projections that are aligned in at least two rows, wherein said embossing pattern further includes at least two of said zones which are adjacent, each zone having a different projection density and/or a different surface area at peaks of said projections so as to produce a relief effect on said product, and wherein a difference in the projections density and/or surface area at the peaks of the projections is greater than 7%, and wherein each peak of the peaks of said projections has a surface area comprising from 0.03 to 0.8 $mm^2$.

2. A product according to claim 1, wherein a ratio between the surface area at the peaks of said projections and the embossed surface area is between 1 and 60%.

3. A product according to claim 2, wherein the ratio between the surface area at the peaks of said projections and the embossed surface area is between 7 and 45%.

4. A product according to claim 1, wherein the embossing pattern includes at least one first zone with projections of a first density, whereby said at least one first zone is surrounded by at least one second zone with projections of a second density that is greater than the first density.

5. A product according to claim 1, wherein the embossing pattern includes at least one linear element.

6. A product according to claim 5, wherein the at least one linear element defines a geometric grid.

7. A product according to claim 6, wherein the at least one linear element defines an aesthetic pattern.

8. A product according to claim 5, wherein the at least one linear element defines an aesthetic pattern.

9. A product according to claim 1, wherein the at least two plies are assembled together by an adhesive.

10. A product according to claim 1, wherein said product contains at least two embossed plies.

11. A product according to claim 10, wherein said product further comprises a third ply which is non-embossed and is arranged between the two embossed plies.

* * * * *